United States Patent [19]

Manson

[11] Patent Number: 4,718,847

[45] Date of Patent: Jan. 12, 1988

[54] KILN SYSTEM

[76] Inventor: Ian Manson, P.O. Box 889, Arden, N.C. 28704

[21] Appl. No.: 29,676

[22] Filed: Mar. 24, 1987

[51] Int. Cl.[4] ..... F27D 3/12

[52] U.S. Cl. ..... 432/241; 432/137; 432/242

[58] Field of Search ..... 432/241, 242, 137

[56] References Cited

U.S. PATENT DOCUMENTS

| | | | |
|---|---|---|---|
| 1,898,042 | 2/1933 | Forse et al. | 432/242 X |
| 2,173,586 | 9/1939 | Herington . | |
| 2,200,619 | 5/1940 | Fallon | 432/242 |
| 2,525,101 | 10/1950 | Robson . | |
| 2,550,807 | 5/1951 | Hanley, Jr. . | |
| 4,005,981 | 2/1977 | Turnbull . | |
| 4,444,557 | 4/1984 | Kimura et al. . | |
| 4,504,221 | 3/1985 | Hartmann | 432/137 |

FOREIGN PATENT DOCUMENTS

| | | | |
|---|---|---|---|
| 2354463 | 10/1973 | Fed. Rep. of Germany | 432/241 |
| 2356823 | 11/1973 | Fed. Rep. of Germany | 432/241 |

*Primary Examiner*—Edward G. Favors

*Attorney, Agent, or Firm*—Roylance, Abrams, Berdo & Goodman

[57] ABSTRACT

A kiln system for heat treating ceramic and metallic material. The system comprises an insulated housing having an open-ended through passageway, a plurality of kiln cars adapted to be received in and pass through the passageway, a plurality of spaced seals coupled to the housing and engageable with leading and trailing walls on each kiln car, and heating and cooling sources. The leading and trailing walls of each kiln car together with the spaced seals subdivide the passageway into zones of differing temperatures. By use of seals located at the ends of the passageway, outer doors for the passageway are unnecessary. By forming the zones of differing temperatures by use of the plurality of spaced seals, a plurality of kiln cars can be moved through the passageway in series one after the other and be subject to pre-heating, heating and cooling temperatures typically used in heat treating without the need of inner doors or a long housing.

23 Claims, 5 Drawing Figures

KILN SYSTEM

FIELD OF THE INVENTION

The invention relates to a kiln system using an insulated housing and a plurality of kiln cars movable through a passageway therein. The passageway is open-ended and has a series of spaced seals engageable with each kiln car to subdivide the passageway into zones of differing temperatures. The system can be used to fire ceramic material including catalysts, pottery and bricks, and to heat treat metallic material.

BACKGROUND OF THE INVENTION

To produce catalysts, pottery and bricks, the ceramic material used therein must be fired at high temperatures in a kiln. In order to successfully fire the ceramic material, it is typically first dried, then pre-heated, heated and cooled at various different temperatures.

In general, three different types of systems are currently utilized to fire ceramic material, although each has its disadvantages. The first type is the batch kiln which is basically a closet formed of insulating material and having a door for receiving the ceramic material. The kiln has thermal inertia, and transition times from one temperature stage to the next can be considerable. Additionally, this system has very low productivity since each set of ceramic materials can only be moved into and removed from the kiln when the heating cycle is completed. Increased production requires a multiplicity of kilns or a larger kiln.

A second type of system is a shuttle kiln which is like a batch kiln except that it has two doors, one in front and one in back. Thus, the materials to be fired, which are typically on a cart, are moved into the shuttle kiln through one door, treated and then removed via that same door. As the first set of materials is removed, the other door is opened and a second cart with a second set of ceramic materials is placed into the kiln. This operation continues back and forth and does speed up the process and make more economical use of labor. However, this system is also basically slow.

A final type of firing system is known as the tunnel kiln. This is a very long kiln which can be 20 to 100 yards in length and through which are continuously moved from one end to the other a series of carts or cars supporting the materials to be treated. The kiln is divided into temperature zones varying with distance from the kiln heat source either by merely utilizing the length of the kiln or by interposing hot gas flow control systems and movable doors at various locations. While this system can treat ceramic material on a large scale, it does have various disadvantages. First, there is a very large capital investment in building such a large apparatus and the gas flow control equipment and door mechanisms are expensive to build and maintain. Second, such a tunnel kiln requires a large space, and third, also requires a large inventory of goods and time to process any one set of materials.

Examples of these prior systems are disclosed in the following U.S. Pats. Nos.: 2,173,586 to Herington; 2,525,101 to Robson; 2,550,807 to Hanley, Jr.; and 4,444,557 to Kimura et al.

Thus, there is a continuing need to improve systems for treating ceramic materials; especially since the prior art does not allow the firing of smaller quantities of ceramics on a continuous basis using the thermal advantages of a tunnel kiln while employing a very short kiln length.

SUMMARY OF THE INVENTION

Accordingly, a primary object of the present invention is to provide an improved kiln system which is capable of continuously processing a larger amount of material than normal batch or shuttle kilns with a reasonably small capital investment.

Another object of the invention is to provide a kiln system that requires relatively little space, a small inventory of materials, and a relatively short time to process the material.

Another object of the invention is to provide a kiln system which has low labor requirements to operate and maintain.

A further object of the invention is to provide such a kiln system without the need for outer or inner doors and which is self-sealing.

The foregoing objects are basically attained by providing a material treating system, the combination comprising an insulated housing having first and second open ends, and a through passageway extending from the first open end to the second open end, the passageway having an inwardly facing surface and a longitudinal axis; a kiln car adapted to be received in and pass through the passageway along the longitudinal axis and to support the material to be treated, the kiln car having an insulated leading wall, an insulated trailing wall and an insulated bottom wall coupled to the leading and trailing walls, the leading and trailing walls being oriented substantially perpendicular to the longitudinal axis; a sealing assembly, coupled to the inwardly facing surface and engageable with the leading and trailing walls when the kiln car is received in a predetermined position in the passageway, for resisting heat transfer along the longitudinal axis and across the leading and trailing walls; and a source, coupled to the housing, for heating or cooling the passageway between the leading and trailing walls.

Advantageously, three kiln cars are utilized in the system and two seals are located inside the passageway to seal the leading and trailing walls of each of the cars. Pairs of seals located in the interior of the passageway are closely adjacent one another to seal the leading wall of one car and the trailing wall of another car so that the kiln cars can be lined up one against the other and pushed through the open-ended passageway.

Other objects, advantages and salient features of the invention will become apparent from the following detailed description, which, taken in conjunction with the annexed drawings, discloses a preferred embodiment of the invention.

DRAWINGS

Referring now to the drawings which form a part of this original disclosure:

DETAILED DESCRIPTION OF THE INVENTION

Figure 1:
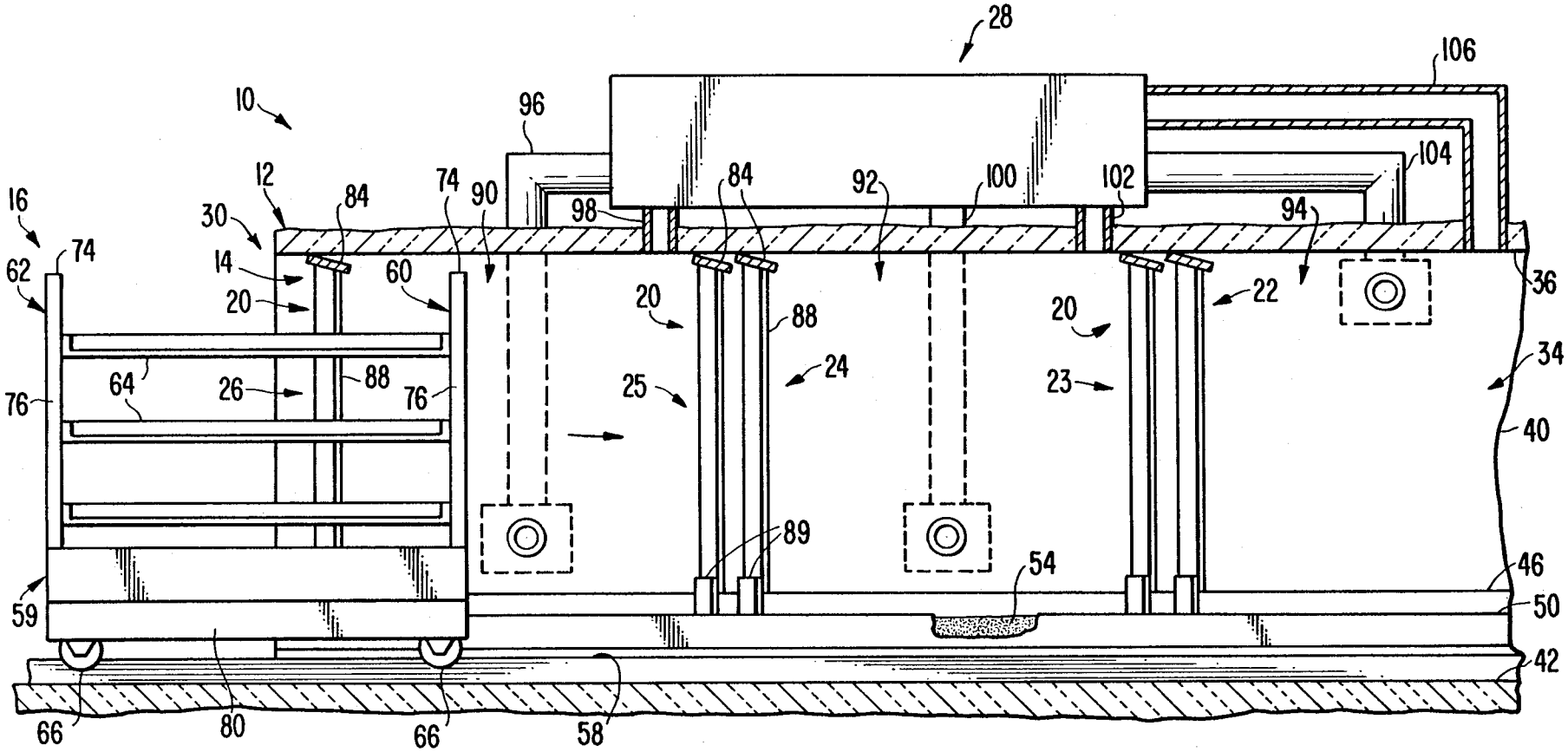
FIG. 1 is a side elevational view in longitudinal section of the kiln system in accordance with the invention showing a first kiln car being maneuvered into the housing.

Referring now to FIGS. 1–5, the kiln system 10 in accordance with the invention comprises a kiln housing 12; an open-ended passageway 14 in the housing; first, second and third kiln cars 16, 17 and 18; a sealing assembly 20; and a source of heating and cooling 28. The sealing assembly 20 comprises first, second, third, fourth, fifth and sixth seals 21–26 spaced through the passageway 14. As seen best in FIGS. 2 and 5, the first and second seals 21 and 22 are associated with and seal the first kiln car 16, the third and fourth seals 23 and 24 are associated with and seal the second kiln car, and the fifth and sixth seals 25 and 26 are associated with and seal the third kiln car 18.

By sealing the inwardly facing surface of the passageway against the kiln cars, the seals essentially create three zones of differing temperature in the passageway without the need for outer or inner doors.

The housing 12 is basically a brick or metal structure with any suitable additional insulating material used therein and has the open-ended passageway 14 extending completely therethrough and defining a longitudinal axis therealong from a first open end 30 to a second open end 32. Advantageously, the entire housing and the passageway are approximately 11 feet long.

The passageway 14 defines an inwardly facing surface 34 having a closed cross section and comprising a horizontally oriented top surface 36, first and second opposed vertical side surfaces 38 and 40, and a horizontal bottom surface 42. The top and bottom surfaces are approximately three feet wide and the side surfaces are approximately six feet high.

Figure 4:
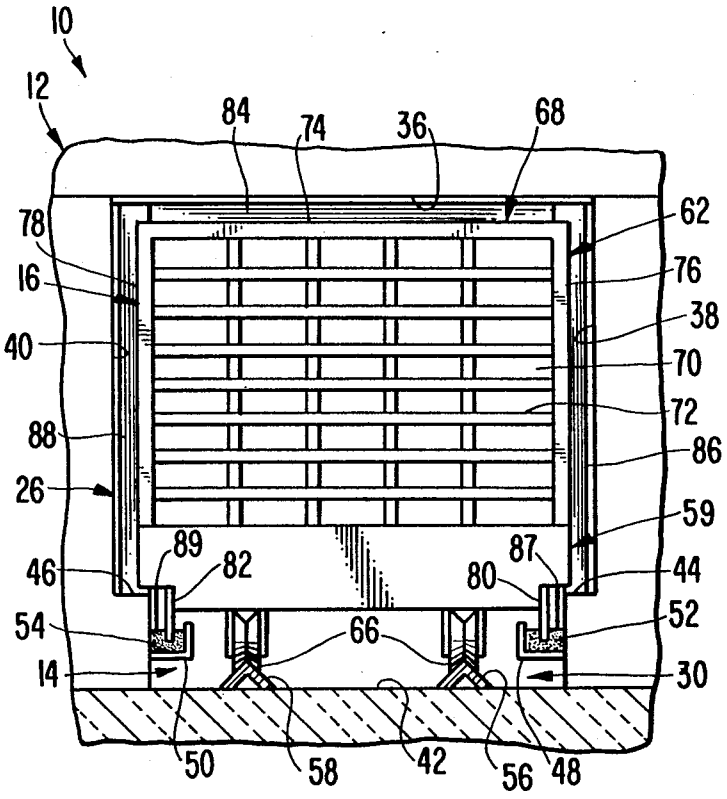
FIG. 4 is a left end elevational view similar to that shown in FIG. 3, except that a kiln car has been positioned inside the housing passageway and its trailing wall is being sealed via the seal shown in FIG. 3.
Figure 3:
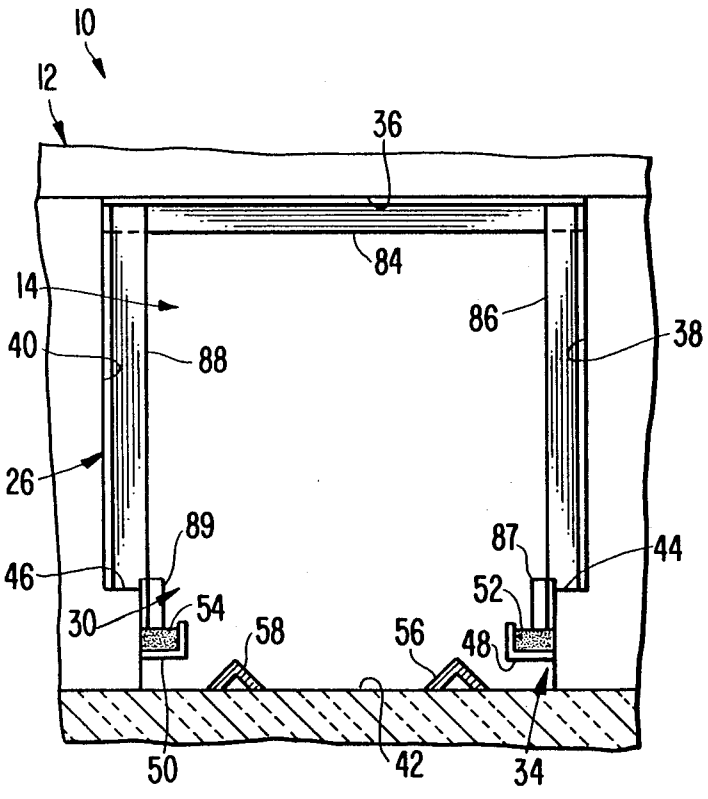
FIG. 3 is a left end elevational view of the system shown in FIGS. 1 and 2 and illustrates an empty housing with a seal being clearly exposed to view.

As seen in FIGS. 3 and 4, the side surfaces 38 and 40 are interrupted by upwardly facing shoulders 44 and 46 which extend horizontally the length of the passageway.

Coupled to the side surfaces 38 and 40 below the shoulders 44 and 46 are a pair of upwardly open channels 48 and 50 which extend the length of the passageway 24 and contain sand 52 and 54 for sealing the bottom side edges of the kiln cars as will be described in more detail hereinafter.

A pair of parallel tracks 56 and 58 extend along the entire length of passageway 14 and outwardly at both open opposite ends for the reception and transfer of the kiln cars.

As seen in FIGS. 1, 2, 4 and 5, the three kiln cars 16, 17 and 18 are each constructed substantially the same and thus only one will be described in detail. For example, the first kiln car 16 as seen in FIGS. 1 and 4 comprises an insulated rectangular bottom wall 59, an insulated rectangular leading wall 60, and an insulated rectangular trailing wall 62, the bottom wall being oriented substantially horizontally and rigidly coupled to the leading and trailing walls, these two walls being oriented substantially vertically and perpendicular to the longitudinal axis of the passageway 14. A series of vertically spaced substantially U-shaped racks 64 are rigidly coupled to the leading and trailing walls to provide rigidity between the walls and support for trays of elements to be heated.

Rotatably coupled to the bottom wall 59 and rotatably engaging the tracks 56 and 58 are a series of wheels 66 for supporting the kiln car.

The bottom wall 59 is advantageously formed from a rigid slab of material, such as steel, and is insulated by any suitable insulation such as a slab of mineral wool block and a layer of ceramic fiber. In addition, both the leading and trailing walls are insulated and are formed by stainless steel, substantially inverted U-shaped channels 68 having an insulated fabric 70 located therein and secured on both sides via mesh 72. Advantageously, the insulating fabric is about one inch thick and is formed from alumina-silica.

Each of the leading and trailing walls 60 and 62 has, as defined by the stainless steel channels 68, a horizontally oriented, straight top edge 74, and vertically oriented opposed first and second side edges 76 and 78, which are also straight. These three edges engage the seals 21–26 to thereby seal the leading and trailing walls of each kiln car with the inwardly facing surface in the passageway, thereby resisting heat transfer along the longitudinal axis of the passageway and across the leading and trailing walls.

As seen best in FIG. 4, an additional sealing action is provided by two vertically oriented and downwardly extending plates 80 and 82, these plates being rigidly coupled to opposed side edges at the bottom of the bottom wall 59 on each kiln car. These plates 80 and 82 are slidably received in channels 48 and 50 below the level of the sand 52 and 54, thereby resisting heat transfer transverse of the longitudinal axis of the passageway and between the bottom wall side edges and the passageway inwardly facing surface.

As seen in FIG. 4, the sides of the bottom wall 59 extend laterally and overlie, in a closely adjacent position, the shoulders 44 and 46 in the side surfaces 38 and 40 of the inwardly facing surface 34.

Figure 2:
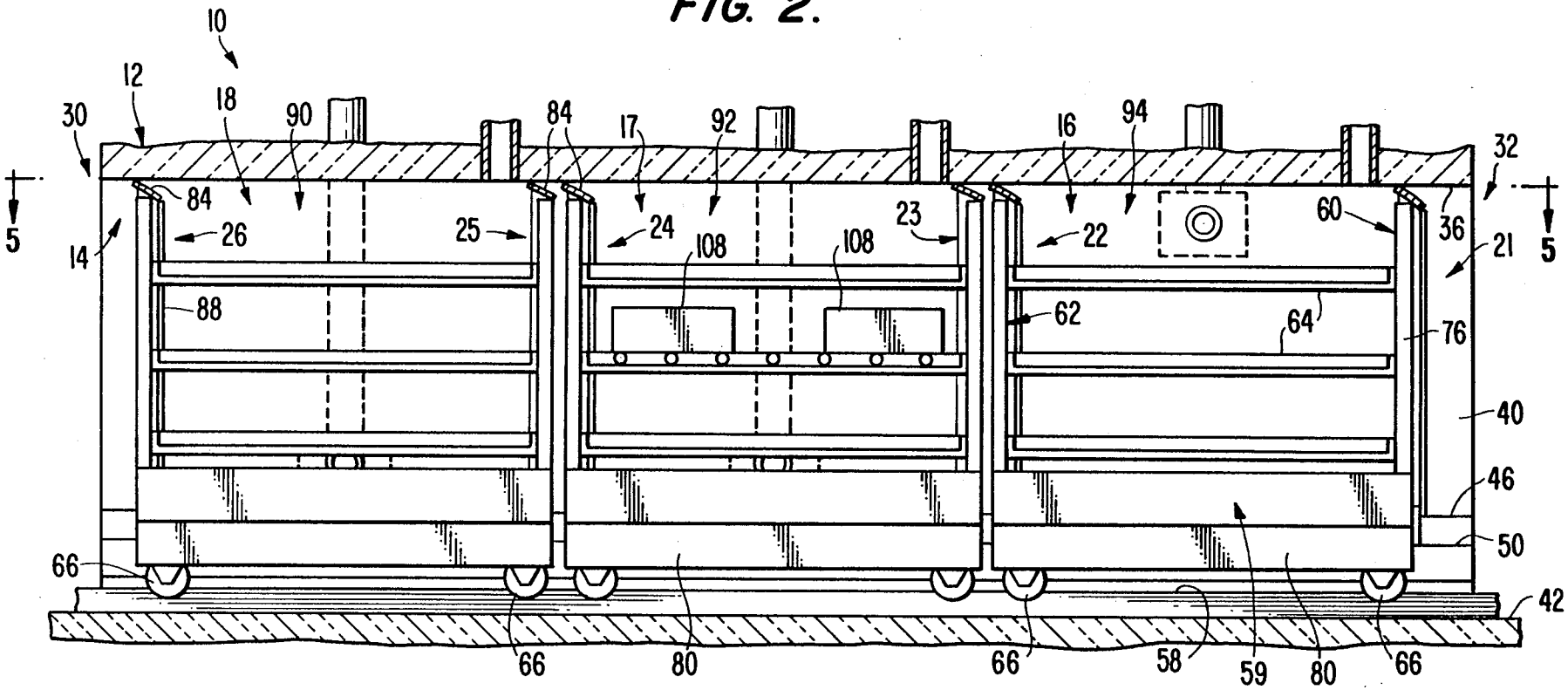
FIG. 2 is a side elevational view in longitudinal section of the system shown in FIG. 1, except that three kiln cars have been loaded in series inside the passageway in the housing.
Figure 5:
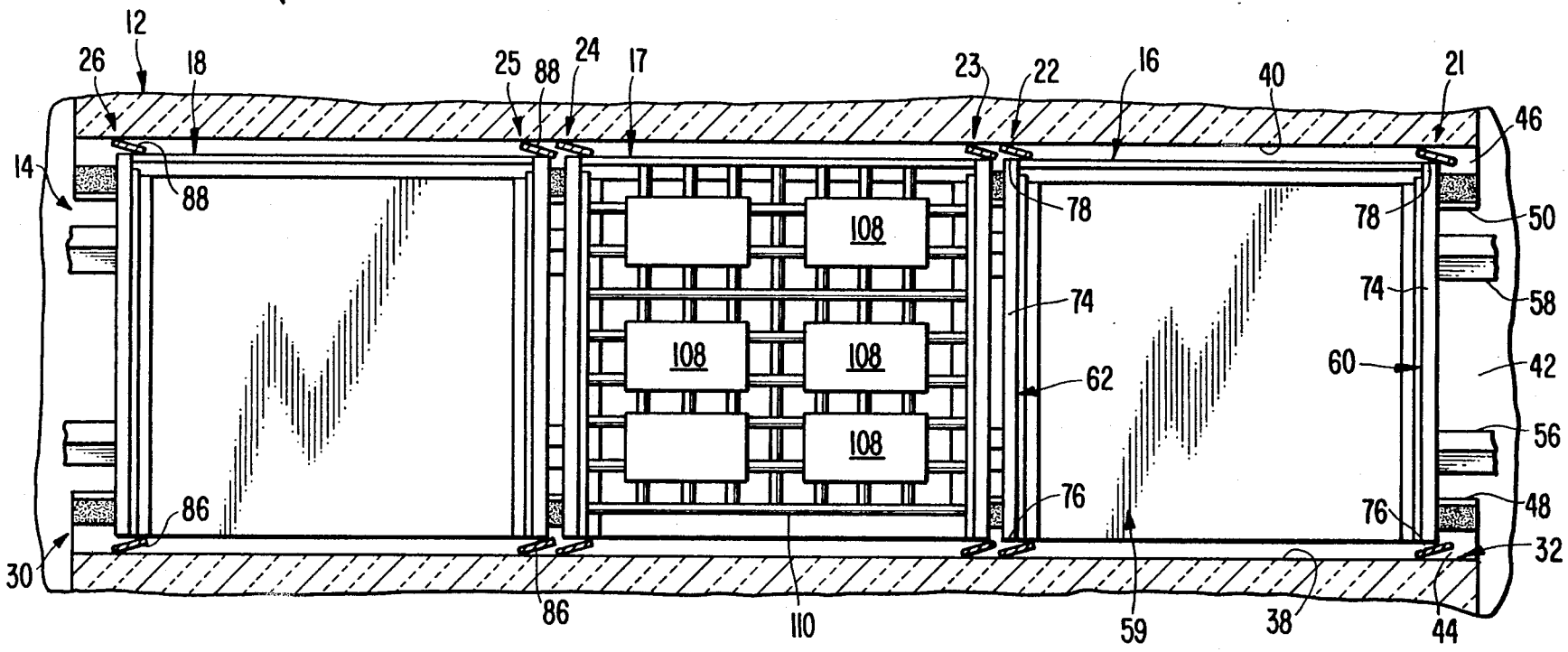
FIG. 5 is a top plan view in section taken along line 5—5 in FIG. 2 showing three kiln cars located inside the housing.

Thus, the cross section of the kiln car 16 is substantially the same but slightly smaller than the cross section of the inwardly facing surface 34 in the passageway. The difference between the outer periphery of the kiln car cross section and the inner periphery of the inwardly facing surface 34 is spanned and closed on the top and sides in spaced intervals by the seals 21–26 as seen in FIGS. 2, 4 and 5. The clearance therebetween is approximately one inch and thus the seals have a transverse extent of greater than one inch and advantageously approximately 2–3 inches.

As seen in FIGS. 1–5, each of six seals 21–26 is substantially the same and therefore only one will be described in detail. Thus, seal 26, for example, is shaped substantially as an inverted U and comprises a horizontally oriented and downwardly extending top member 84, and two opposed first and second side members 86 and 88, which are vertically oriented, all three members being substantially coplanar. Seal 26 also comprises third and fourth side members 87 and 89 which are vertically oriented and extend downwardly and inwardly from the first and second side members 86 and 88 into contact with sand 52 and 54 in channels 48 and 50. Each of the members are formed from flexible, heat resistant, insulating fabric advantageously formed from alumina-silica. The fabric is advantageously fairly thin and can have a thickness of about 1/16 to about ¼ inch. These seal members are rigidly coupled to the top surface 36, first side surface 38 and second side surface 40 on the inwardly facing surface 34 by any suitable means, such as by tacks. As seen in FIG. 3, the top member 84 extends completely across the top surface 36 and the first and second side members 86 and 88 extend vertically from the top surface 36 to the shoulders 44 and 46. These seal members extend inwardly of the passageway in a position to engage and seal against the top edge 74, first side edge 76 and second side edge 78 of the leading and trailing walls 60 and 62 of each of the kiln cars in the predetermined positions shown in FIGS. 2 and 5. Seal members 87 and 89 seal against plates 80 and 82 extending downwardly from each kiln car, and against the sand.

As seen in FIG. 2, the first seal 21 is adjacent open end 32 of the passageway and the sixth seal 26 is adjacent open end 30 of the passageway. When these seals 21 and 26 engage the leading and trailing walls of respective kiln cars, they in effect form barriers between the outside of the housing and the inside, thereby acting substantially as outer doors. Although three kiln cars are shown in FIG. 2, it is contemplated that only one kiln car could be used and thus seals 21 and 26 would seal against the leading and trailing walls of a single kiln car.

The second, third, fourth and fifth seals 22–25 are located in the interior of the passageway and seal the remaining trailing and leading walls of the cars as seen in FIGS. 2 and 5. In order to conserve space, the kiln cars are advantageously in contact with one another, although they are shown slightly spaced for clarity in FIGS. 2 and 5. By having the kiln cars in close contact, seals 22 and 23 are closely adjacent and essentially form a double seal in that location. The same is true for closely adjacent seals 24 and 25.

As seen in FIG. 1, the heating and cooling source 28 provides the necessary temperatures to the interior of the housing and can be powered by any suitable gas burners to provide heat or any type of air conditioner or ambient air pumps for cooling. Suitable additional fans, flues and chimneys can also be utilized with the system 10. The heating and cooling source 28 provides heat in first and second zones 90 and 92 and cooling to the third zone 94. As seen in FIG. 2, these zones 90, 92 and 94 are defined by the series of seals and also correspond to the volume defined between the leading and trailing walls of each of the cars.

The heating and cooling source 28 provides hot air to the first zone 90 via an inlet conduit 96 and removes that heated air via outlet conduit 98. Similarly, heated air is introduced into the second zone 92 via inlet conduit 100 and exits via outlet conduit 102. Preferably, the first zone 90 is a pre-heating zone and the second zone 92 is the actual heating or soaking zone, which is maintained at a high temperature, such as 400°–1,000° C., which is higher than the pre-heating temperature. In zone 3, cooling air is introduced via inlet conduit 104 and exits via outlet conduit 106. Although shown for use in the pre-heating, heating and cooling operations, the system 10 can also be used to dry the ceramic or metallic material prior to these three operations.

In operation, the ceramic or metallic material 108 to be filed in the system 10 is placed on mesh supports or trays 110 which are in turn supported on the racks 64 in each car.

Then, with the passageway 14 being empty, the first kiln car 16 is pushed into the passageway as seen in FIG. 1. This can be done manually or with mechanical assistance. The car is pushed into the passageway so that the leading wall 60 engages seal 20 and the trailing wall 62 engages seal 26, which is visible through the open end 30. In this position, the pre-heating zone 90 is activated to pre-heat the materials on the car.

Once this is finished, a second car 17 is placed so that its leading wall 60 is adjacent to the trailing wall 62 of the first car 16 and is pushed longitudinally of the passageway, until the first car 16 is located in the second zone 92 and the second car 17 takes the place of the first car in the first zone 90. Then, the required heating of the materials on the first car 16 takes place in the second zone 92, while the material on the second car 17 undergoes pre-heating in the first zone 90. In this position, the leading and trailing walls of the first car 16 engage and are sealed via seals 23 and 24, while the leading and trailing walls of the second car 17 engage and are sealed by seals 25 and 26 in the first zone 90.

Once these two heating operations are completed, the third kiln car 18 is maneuvered into contact with the second car 17 and pushed longitudinally into the passageway. This movement continues until the first car is in the third zone 94, the second car 17 is in the second zone 92 and the third car is in the first zone 90 as seen specifically in FIG. 2. In this position, seals 21 and 22 seal against the leading and trailing walls of the first car, seals 23 and 24 seal against the leading and trailing walls of the second car, and seals 25 and 26 seal against the leading and trailing walls of the third car. Once the cooling operation is completed in the third zone 94, the heating operation is completed in the second zone 92 and the pre-heating operation is completed in the first zone 90, a fourth car, not shown, is maneuvered into engagement with the third car 18 and pushed longitudinally into the passageway.

This causes the first car 16, whose ceramic or metallic material 108 has been fired and cooled to the necessary extent, to exit from the passageway via the second open end 32. In addition, the second car 17 will move into the third zone 94, the third car 18 will move into the second zone 92, and the fourth car will move into the first zone 90.

This sequence continues continuously and provides a uni-directional flow of kiln cars through the housing.

By utilizing the seals, outer and inner doors on the housing are unnecessary and by forming the three zones of differing temperatures by use of the plurality of spaced seals, the plurality of kiln cars can be moved through the passageway in series, one after the other, and are subject to the pre-heating, heating and cooling temperatures provided in the housing without the need for inner doors or a long housing.

Since the housing can accommodate three kiln cars, the firing operation an take place relatively quickly and with little labor or maintenance required. However, since the overall housing is relatively short, capital investment and space are saved as well as the requirement of considerable inventory passing through the firing process. In addition, since the housing is relatively short, any individual set of ceramic or metallic materials can be completely fired in a relatively short period of time.

While one advantageous embodiment has been chosen to illustrate the invention, it will be understood by those skilled in the art that various changes and modifications can be made therein without departing from the scope of the invention as defined in the appended claims. For example, while not as durable as the configuration shown in FIGS. 1–5, the sealing members could be located on each kiln car and engage the inner surface of the passageway.

What is claimed is:

1. A material treating system, the combination comprising:

an insulated housing having first and second open ends, and a through passageway extending from said first open end to said second open end, said passageway having an inwardly facing surface and a longitudinal axis;

a kiln car adapted to be received in and pass through said passageway along said longitudinal axis and to support the material to be treated;

said kiln car having an insulated leading wall, an insulated trailing wall and an insulated bottom wall coupled to said leading and trailing walls, said leading and trailing walls being oriented substantially perpendicular to said longitudinal axis;

sealing means, coupled to said inwardly facing surface and engageable with said leading and trailing walls when said kiln car is received in a predetermined position in said passageway, for resisting heat transfer along said longitudinal axis and across said leading and trailing walls; and means, coupled to said housing, for heating or cooling said passageway between said leading and trailing walls.

2. A system according to claim 1, wherein said sealing means is flexible.

3. A system according to claim 1, wherein said sealing means comprises heat resistant fabric.

4. A system according to claim 1, wherein said sealing means comprises a first sealing assembly located adjacent said first open end and a second sealing assembly located adjacent said second open end.

5. A system according to claim 1, wherein said sealing means comprises first and second sealing assemblies which are spaced apart along said longitudinal axis a distance substantially equal to the distance between said leading and trailing walls.

6. A system according to claim 1, wherein said leading wall includes two side edges and a top edge, said sealing means includes two side members and a top member engageable respectively with said two side edges and said top edge of said leading wall, said trailing wall includes two side edges and a top edge, and said sealing means further includes two side members and a top member engageable respectively with said two side edges and said top edge of said trailing wall.

7. A system according to claim 6, wherein said two side members engageable with said leading wall are substantially vertically oriented, said top member engageable with said leading wall is substantially horizontally oriented, said two side members engageable with said trailing wall are substantially vertically oriented, and said top member engageable with said trailing wall is substantially horizontally oriented.

8. A system according to claim 1, wherein said passageway has a pair of tracks extending therein along said longitudinal axis, and said kiln car has a plurality of wheels thereon engageable with said tracks.

9. A system according to claim 1, wherein said kiln car bottom wall has a pair of side edges, and said system further comprises additional sealing means, coupled to said bottom wall side edges and to said passageway inwardly facing surface, for resisting heat transfer transverse of said longitudinal axis and between said bottom wall side edges and said passageway inwardly facing surface.

10. A sealing according to claim 9, wherein said additional sealing means comprises a pair of plates coupled to said bottom wall side edges and extending downwardly, and a pair of upwardly open channels coupled to said inwardly facing surface on opposite sides of said passageway, having sand located therein, and slidably receiving said pair of plates respectively therein.

11. A material treating system, the combination comprising:

an insulated housing having first and second open ends, and a through passageway extending from said first open end to said second open end, said passageway having an inwardly facing surface and a longitudinal axis;

a plurality of kiln cars adapted to be received in and pass through said passageway along said longitudinal axis and to support the material to be treated;

each of said kiln cars having an insulated leading wall, an insulated trailing wall and an insulated bottom wall coupled to said leading and trailing walls, said leading and trailing walls being oriented substantially perpendicular to said longitudinal axis;

a series of sealing means, coupled to said inwardly facing surface and engageable respectively with said leading and trailing walls of each of said kiln cars when said kiln cars are received in predetermined positions in said passageway, for resisting heat transfer along said longitudinal axis and across said leading and trailing walls of each of said kiln cars; and means, coupled to said housing, for heating or cooling said passageway between said leading and trailing walls of each of said kiln cars.

12. A system according to claim 11, wherein each of said sealing means is flexible.

13. A system according to claim 11, wherein each of said sealing means comprises heat resistant fabric.

14. A system according to claim 11, wherein said series of sealing means comprises a first sealing assembly located adjacent said first open end and a second sealing assembly located adjacent said second open end.

15. A system according to claim 11, wherein said series of sealing means comprises, for each of said kiln cars, first and second sealing assemblies which are spaced apart along said longitudinal axis a distance substantially equal to the distance between said leading and trailing walls on the associated kiln car.

16. A system according to claim 11, wherein each of said leading walls includes two sides edges and a top edge, each of said sealing means includes two side members and a top member engageable respectively with said two side edges and said top edge of each of said leading walls, each of said trailing walls includes two side edges and a top edge, and each of said sealing means further includes two side members and a top member engageable respectively with said two side edges and said top edge of each of said trailing walls.

17. A system according to claim 16, wherein each of said two side members engageable with each of said leading walls are substantially vertically oriented, each of said top members engageable with each of said leading walls is subtantially horizontally oriented, each of said two side members engageable with each of said trailing walls are substantially vertically oriented, and each of said top members engageable with each of said trailing walls is substantially horizontally oriented.

18. A system according to claim 11, wherein said passageway has a pair of tracks extending therein along said longitudinal axis, and each of said kiln cars has a plurality of wheels thereon engageable with said tracks.

19. A system according to claim 11, wherein each of said kiln car bottom walls has a pair of side edges, and said system further comprises additional sealing means, coupled to each of said bottom wall side edges and to said passageway inwardly facing surface, for resisting heat transfer transverse of said longitudinal axis and between each of said bottom wall side edges and said passageway inwardly facing surface.

20. A system according to claim 19, wherein said additional sealing means comprises a pair of plates coupled to each of said bottom wall side edges and extending downwardly, and a pair of upwardly open channels coupled to said inwardly facing surface on opposite sides of said passageway, having sand located therein, and slidably receiving each of said pair of plates respectively therein.

21. A system according to claim 11, wherein said series of sealing means includes at least two substantially adjacent interior sealing assemblies, one of said interior sealing assemblies engageable with a leading wall of one of said kiln cars and the other of said interior sealing assemblies engageable with a trailing wall of another of said kiln cars.

22. A system according to claim 11, wherein said kiln cars each have substantially the same length, and said passageway has a length along said longitudinal axis which is substantially equal to the length of each kiln car multiplied times the number of kiln cars receivable in said passageway.

23. A system according to claim 11, wherein said passageway has a transverse cross section substantially the same as the outer periphery of each of said kiln cars except slightly larger.

* * * * *